US006766784B2

(12) United States Patent
Imafuku et al.

(10) Patent No.: US 6,766,784 B2
(45) Date of Patent: Jul. 27, 2004

(54) FOUR-CYCLE ENGINE

(75) Inventors: Kenji Imafuku, Hiroshima (JP); Hidenori Hiraki, Hiroshima (JP); Tadafumi Miyamoto, Hiroshima (JP); Yuki Terada, Hiroshima (JP)

(73) Assignee: Shindaiwa Kogyo Co., Ltd. (JP)

( * ) Notice: Subject to any disclaimer, the term of this patent is extended or adjusted under 35 U.S.C. 154(b) by 144 days.

(21) Appl. No.: 10/215,930

(22) Filed: Aug. 9, 2002

(65) Prior Publication Data

US 2003/0037764 A1 Feb. 27, 2003

(51) Int. Cl.[7] ..... F02B 75/02
(52) U.S. Cl. ..... 123/317
(58) Field of Search ..... 123/317, 196 R

(56) References Cited

U.S. PATENT DOCUMENTS

| | | | | |
|---|---|---|---|---|
| 1,396,418 | A | | 11/1921 | Gilliard |
| 2,391,380 | A | | 12/1945 | Barker |
| 2,946,324 | A | | 7/1960 | Casini |
| 3,613,646 | A | | 10/1971 | Hisada |
| 3,672,172 | A | | 6/1972 | Hammond |
| 3,859,968 | A | | 1/1975 | Stinebaugh |
| 3,973,532 | A | | 8/1976 | Litz |
| 4,156,416 | A | * | 5/1979 | Weisgerber et al. .... 123/196 R |
| 4,169,434 | A | | 10/1979 | Guenther |
| 4,194,470 | A | | 3/1980 | Magner |
| 4,471,728 | A | | 9/1984 | Borst et al. |
| 4,473,340 | A | | 9/1984 | Walsworth |
| 4,488,519 | A | | 12/1984 | Kishida |
| 4,538,567 | A | | 9/1985 | Grow |
| 4,538,569 | A | | 9/1985 | Sugino et al. |

(List continued on next page.)

FOREIGN PATENT DOCUMENTS

| | | |
|---|---|---|
| CA | 1255607 | 6/1989 |
| CH | 248605 | 2/1948 |
| DE | 2411513 | 9/1975 |
| DE | 3314721 A1 | 10/1984 |
| EP | 94106092.3 | 12/1994 |
| FR | 2519695 | 7/1983 |
| GB | 2 30 475 | 12/1909 |
| IT | 474143 | 9/1952 |
| JP | 47-35516 | 11/1972 |
| JP | 51-149408 | 12/1976 |
| JP | 59-77036 | 10/1982 |
| JP | 58-85320 | 5/1983 |
| JP | 59-229017 | 12/1984 |
| JP | 61-200330 | 9/1986 |
| JP | 61-49130 | 11/1986 |
| JP | 62-17320 | 1/1987 |
| JP | 62-35027 | 2/1987 |

OTHER PUBLICATIONS

Chinn, Peter, "Engine Review", article, May 1981, pp 32–34; 90–91.

(List continued on next page.)

*Primary Examiner*—Thomas Denion
*Assistant Examiner*—Zelalem Eshete
(74) *Attorney, Agent, or Firm*—Schwabe, Williamson & Wyatt, P.C.

(57) ABSTRACT

A four-cycle engine fueled by a mixture of fuel and lubricant and including valve actuation mechanism contained in the path of the fuel flow. A component of the mechanism including a rotating gear having a gear shaft journalled between wall portions of the engine whereat the wall portions define in part the flow path of the fuel. Through holes provided in the walls to direct fuel-lubricant to the shaft ends journalled in the wall portions for lubrication of the said shaft ends.

4 Claims, 4 Drawing Sheets

U.S. PATENT DOCUMENTS

| | | | | | |
|---|---|---|---|---|---|
| 4,558,671 | A | | 12/1985 | Stinebaugh | |
| 4,617,879 | A | | 10/1986 | Mori | |
| 4,632,085 | A | | 12/1986 | Misawa et al. | |
| 4,682,570 | A | | 7/1987 | Velencei | |
| 4,708,107 | A | | 11/1987 | Stinebaugh | |
| 4,864,979 | A | | 9/1989 | Eickmann | |
| 4,955,943 | A | | 9/1990 | Hensel et al. | |
| 5,005,537 | A | | 4/1991 | Maissant | |
| 5,072,699 | A | | 12/1991 | Pien | |
| 5,176,116 | A | * | 1/1993 | Imagawa et al. | 123/196 W |
| 5,279,269 | A | | 1/1994 | Aizawa et al. | |
| 5,343,839 | A | | 9/1994 | Baika et al. | |
| 5,347,967 | A | | 9/1994 | Todero et al. | |
| 5,419,289 | A | | 5/1995 | Duret et al. | |
| 5,579,735 | A | | 12/1996 | Todero et al. | |
| 5,586,523 | A | | 12/1996 | Kawahara et al. | |
| 5,628,295 | A | | 5/1997 | Todero et al. | |
| 5,657,724 | A | | 8/1997 | Brown et al. | |
| 5,678,525 | A | | 10/1997 | Taue | |

OTHER PUBLICATIONS

"New Environmental Technology Developed for Portable Lawn & Garden Engines", article, Ryobi News, Nov. 17, 1992, pp 1–19, Ryobi America Corporation.

Okanishi, Naoki, Itaru Fukutani, Eiichi Watanbe, "Torque Boosting of 4–Stroke Cycle Spark–Ignition Engine in Low and Middle Engine Speed Ranges by Crankcase–Supercharging" article, Feb. 27, 1984, SAE Technical Paper Series 840423.

Okanishi, Naoki, Itaru Fukutani, "Application of Crankcase–Supercharging to a 4–Stroke Cycle Compression Ignition Engine", article, Feb. 28, 1994, SAE Technical Paper Series 940840.

Okanishi, Naoki, Itaru Fukutani, "On–Road Tests Using Small Crankcase–Supercharged 4–Stroke Cycle Engines", article, Feb. 28, 1994, SAE Technical Paper Series 940841.

* cited by examiner

FOUR-CYCLE ENGINE

Priority is claimed under 35 USC §119(*a*) based on Japanese Patent Application Serial No. 2001-243661 filed Aug. 10, 2001.

FIELD OF INVENTION

This invention relates to four-cycle engines having as a fuel source a gas-lubricant mixture and in particular it relates to the manner of lubricating certain of the components of the engine.

BACKGROUND OF THE INVENTION

The benefit of using a gas-lubricant fuel source for a four-cycle engine is that certain of the moving parts, e.g., the actuating mechanism for the intake and exhaust valves, can be placed in the flow path of the fuel for lubrication thereof. This is particularly beneficial for small engines which are operated in all manners of positions and wherein the oil bath form of lubrication that is typical for four-cycle engines is not practical.

In such engines there are nevertheless moving parts that are not so readily lubricated. An example is the cam gear shaft which is journalled at its ends in the walls of the engine. It is conventional for the journalling of such shafts to mount the shafts in bearings, e.g., roller or ball bearings and such bearings are an added expense which could be diminished if instead the shafts were mounted in lubricated bushings.

BRIEF SUMMARY OF THE INVENTION

The present invention provides an engine design wherein at least one of the journalled components is journalled in the vicinity of the fuel flow and ports are strategically positioned to provide fuel flow as required to lubricate the component. This obviates the need for bearings and reduces the cost of manufacturer without sacrificing wear life of the engine.

The various ways for providing fuel-lubricant to the bushing of the journalled components will be further appreciated and understood upon reference to the following detailed description having reference to the accompanying drawings.

DETAILED DESCRIPTION OF THE PREFERRED EMBODIMENT

Figure 5:
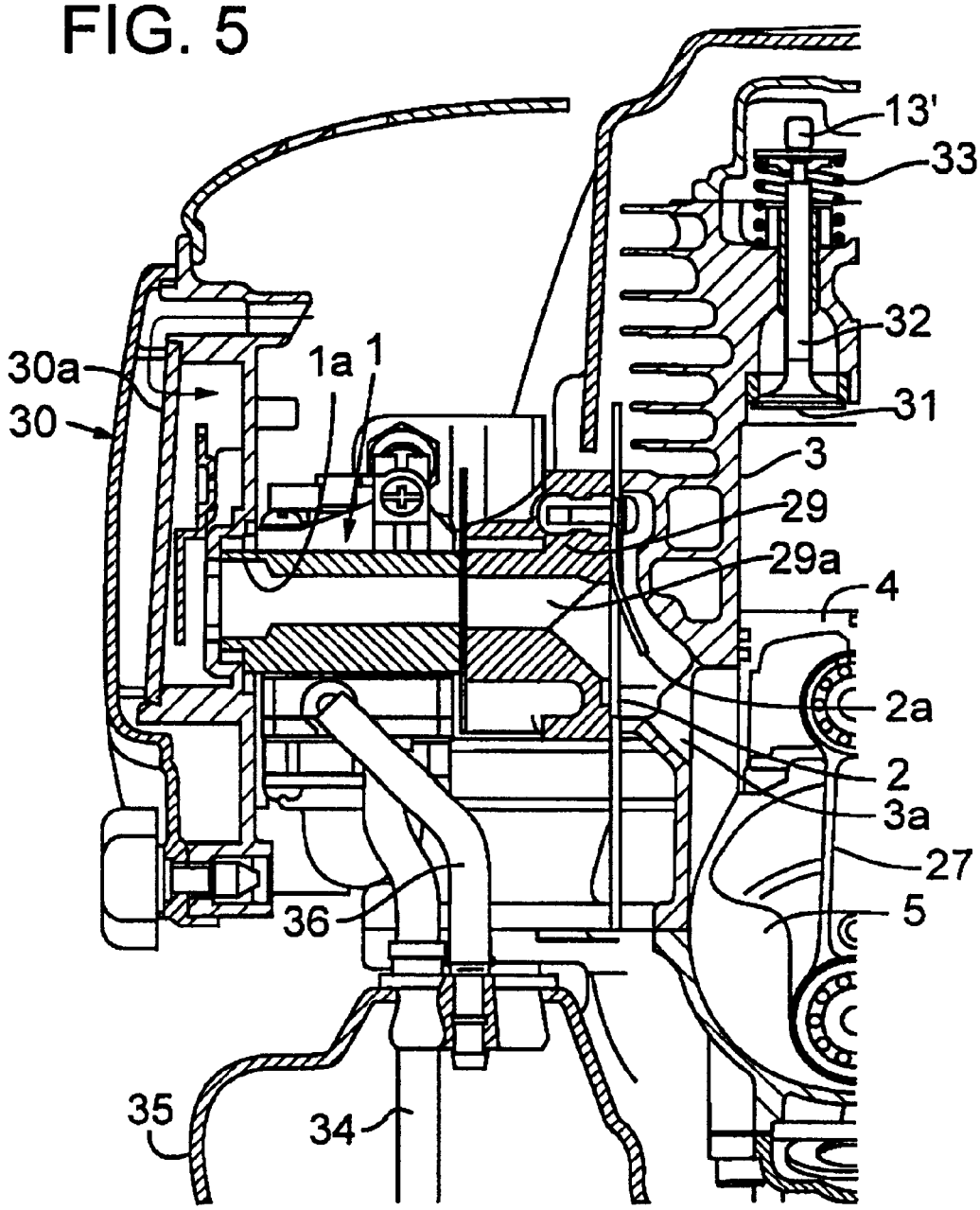
FIG. 5 is a cross-sectional view as if taken generally along the view lines 5—5 of FIG. 4.

Reference is first made to FIG. 5 which illustrates the fuel intake side of a four-cycle engine in accordance with the present invention. Reference 1 indicates a carburetor and reference number 35 indicates a fuel source for the carburetor, i.e., a gas-oil mixture which flows to the carburetor from fuel supply line 34. Line 36 is a return line that is well known to the art. Air enters the carburetor 1 through air cleaner 30 (item 3*a* being the air filter). The carburetor produces the mixture of air-gas and lubricant (oil) which flows through passage 29*a* and into cylinder 3 through check valve 2 (item 2*a* being the pressure plate or valve shutoff cover).

Figure 4:
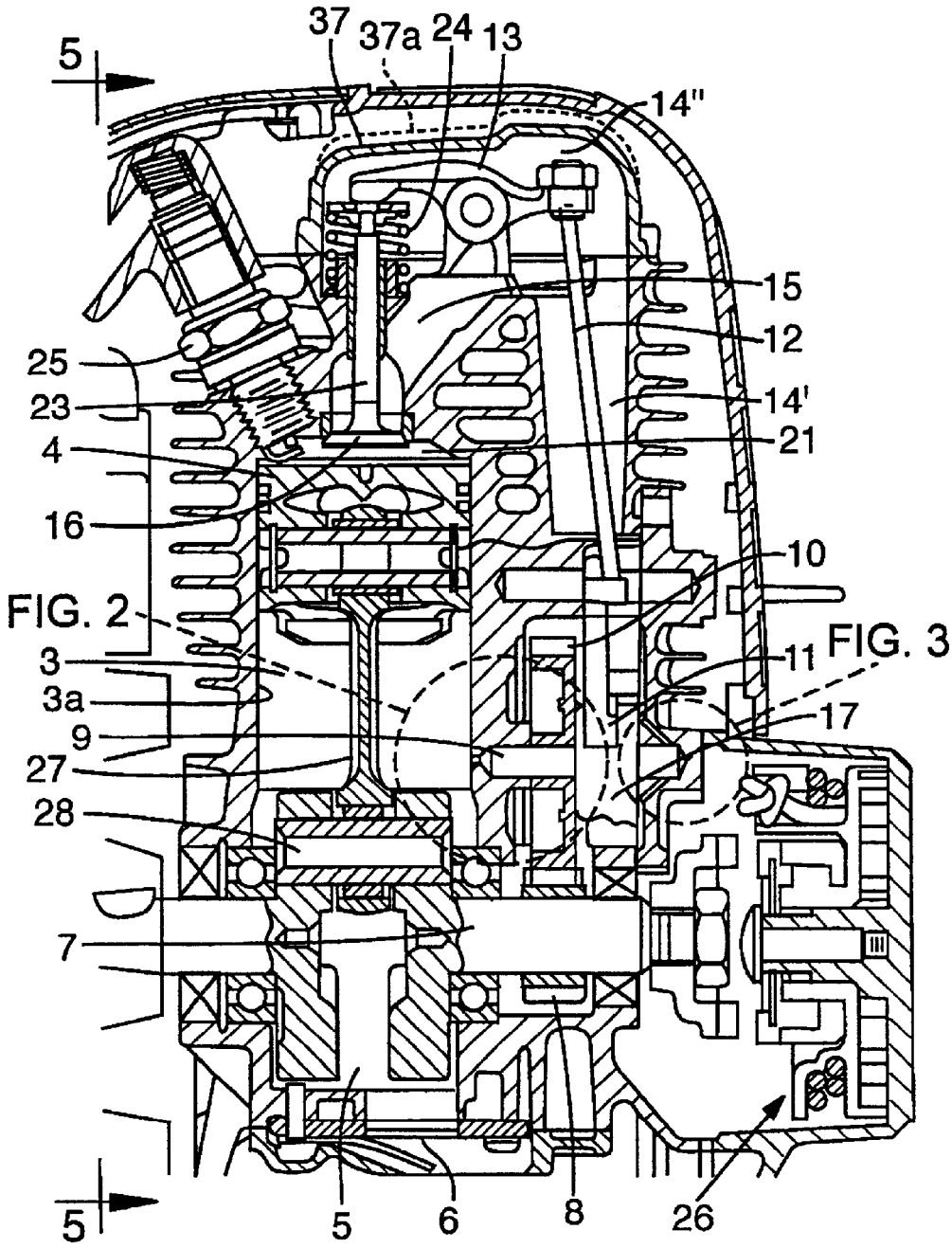
FIG. 4 is a cross-sectional view as if taken generally along the view lines 4—4 of FIG. 1.

With reference now also to FIG. 4, the cylinder 3 houses a piston 4 that is connected by connecting rod 27 to a crank pin 28 which is connected to crank shaft 7. As the piston reciprocates up and down, the crank pin 28 rotates about and with rotation of crank shaft 7. The upper end of the cylinder 3 provides a combustion chamber 37 in which vaporized fuel is deposited and ignited (by spark plug 25) to cause the piston to reciprocate up and down in the cylinder. The fuel flows into the combustion chamber through intake valve 16 and the exhaust flows out of the combustion chamber to atmosphere through valve 31.

With reference to FIG. 4, it will be appreciated that the piston 4 provides a pumping action that pumps the fuel from the crank case chamber through check valve 6 and into a passage that is formed into and around the timing gear 8 (driven by crank shaft 7), into and through cam gear 10 and along the push rods 12 to the overhead rocker arms 13 from which it flows through passage 15 to the intake valve 16. This flow is diagrammatically illustrated in FIG. 1 by arrows which travel along inner wall 14*a* and around the cam gear 10 and into chamber 14', which houses push rod 12, and then to chamber 14", housing rocker arms 13.

Figure 1:
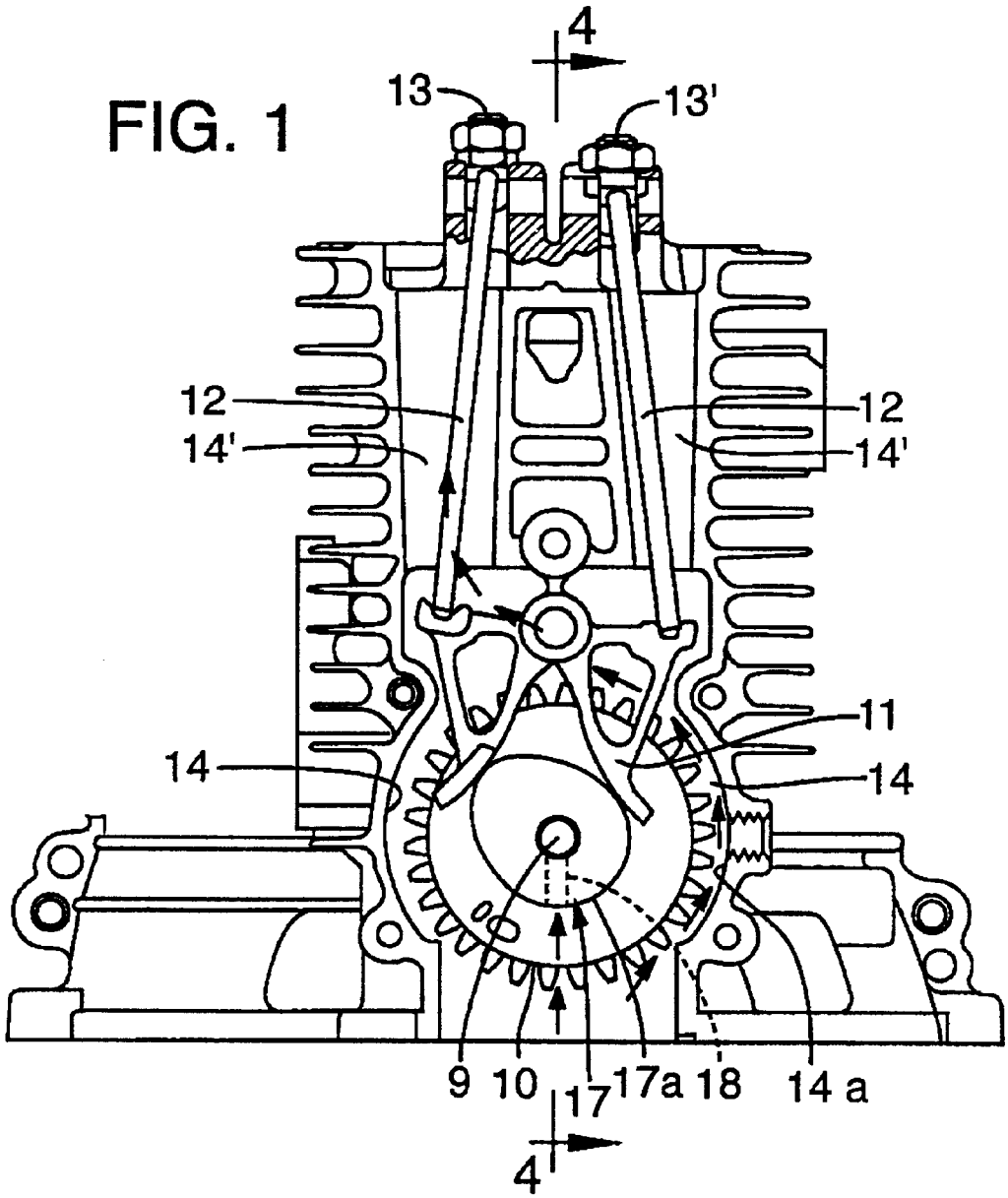
FIG. 1 is a diagrammatic view of a four-cycle engine including a cam gear and camshaft that is lubricated in accordance with the present invention.
Figure 2:
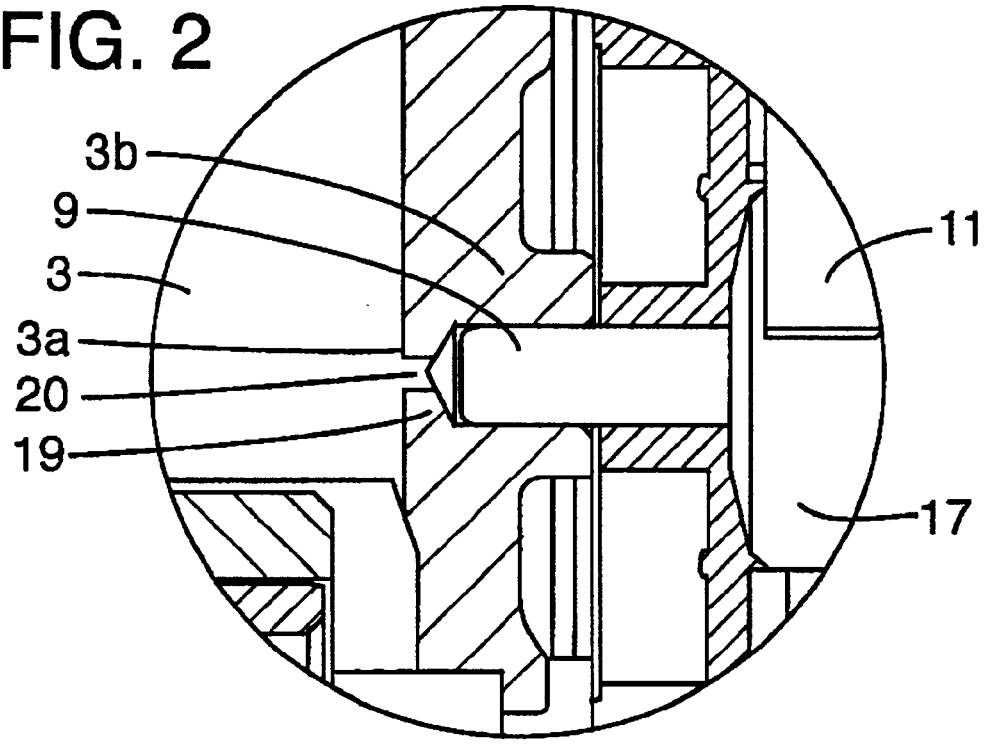
FIG. 2 is a view of one end of the camshaft of FIG. 1.
Figure 3:
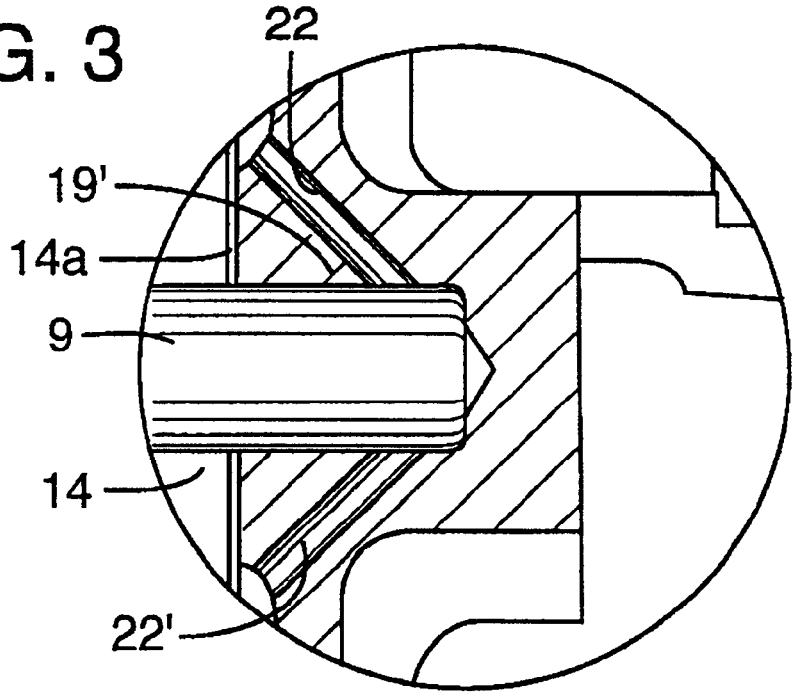
FIG. 3 is a view of the other end of the camshaft of FIG. 1.

Refer now to the areas indicated in FIG. 4 which are further illustrated in FIGS. 2 and 3 respectively. Shown is the cam gear 10 which is mounted on cam shaft 9, cam shaft 9 being rotatively mounted in the cylinder wall. The cam 17, cam gear 10 and cam shaft 9 are diagramatically illustrated in FIG. 1. As the cam gear is rotated by timing gear 8, the valve lifter 11 is rocked back and forth which actuates rocker arms 13, 13' and thus opens valves 16 and 31 (closure being accomplished by springs 24 and 33 as permitted by cam 17).

The cam shaft 9 as will be noted is not mounted in bearings but rather bushing parts 19 and 19' (in FIGS. 2 and 3 respectively). As will be particularly seen in FIG. 2, cylinder wall 3*a* is provided with a hole 20 that leads to the one end of crank shaft 9. As will be noted in FIG. 4, this portion of the cylinder 3 is filled with the fuel-lubricant mixture which is compressed in the downstroke of piston 4 and which is caused to enter opening 20 to provide lubrication for the one end of crank shaft 9.

Refer now to the other end of crank shaft 9, again shown in FIG. 4 but refer also to FIG. 3. Recall that the fuel-lubricant mixture flows into and around the cam gear 10 and particularly along inner wall 14*a* from which through holes 22 and 22' are provided. Holes 22, 22' extend to the other end of gear shaft 9 as shown in FIG. 3, to lubricate that end.

From FIG. 1, further lubrication of the cam shaft 9 is provided by a through hole 18 that extends from base circle surface 17*a* of cam 17, which is integral to cam gear 10, to the outer diameter surface of cam gear shaft 9. The lubricating oil, which collects at the bottom part of chamber 14, in which cam gear 10 is disposed, is splashed upwards by the rotation of cam gear 10. This enables the oil to permeate through the through hole 18 to the outer diameter of cam gear shaft 9 and improve the lubrication affect between cam gear shaft 9 and cam gear 10.

In a four-cycle engine as herein described, by setting the through hole 18 so that it faces directly downwards when the intake valve lifter 11 is pushed by cam 17 and push rod 12 is pushed by intake valve lifter 11 so that the intake valve opens, the through hole 18 will be positioned so as to face the direction of inflow of the fuel-air mixture and the lubrication oil contained in the mixture will thereby more effectively enter through hole 18.

The invention as described in connection with the above embodiment is subject to numerous modifications and variations. Accordingly, the scope of the invention as intended is to be interpreted based on the definition of the claims herein and are not limited to the specific embodiment disclosed.

The invention claimed is:

1. A four-cycle engine fueled by a fuel-lubricant mixture comprising:

a cylinder, a piston slidably mounted in the cylinder, a combustion chamber formed at one end of the cylinder and a crank case chamber formed at the other end whereby reciprocation of the piston in the cylinder produces suction and compression alternately in the combustion chamber and the crank case chamber;

a fuel flow path into and out of the crank case chamber and extended outside the cylinder to the combustion chamber;

a valving system that controls the flow of fuel along said flow path and into the combustion chamber, and valve actuating mechanism contained in the flow path between the crank case chamber and the combustion chamber for lubrication of said actuating mechanism provided by lubricant contained in a fuel-lubricant mixture;

a component of said actuating mechanism being a rotating gear including a shaft having shaft ends mounted in bushings provided in a pair of spaced-apart wall portions forming in part said flow path for the fuel-lubricant mixture, and a through hole into one of said wall portions closely spaced from a bushing and extended angularly toward and into the bushing, said through hole receiving the fuel-lubricant mixture for lubrication of a shaft end contained in said bushings.

2. A four-cycle engine as defined in claim 1 wherein the other of said wall portions is also a wall portion of the cylinder at a side of said wall portion opposite the rotating gear, said side of said wall portion of said cylinder exposed to fuel flow as the fuel flows into and out of the crank case chamber, and a through hole through the wall portion from the cylinder side and to the bushing of the corresponding shaft end, said through hole receiving the fuel-lubricant mixture for providing lubricant to the shaft end.

3. A four-cycle engine as defined in claim 2 wherein said rotating gear is a cam gear, a cam integral to said cam gear and surrounding said cam shaft, a through hole in said cam extended from the exterior to the cam shaft, said cam exposed to the fuel flow as the cam gear is rotated whereby fuel-lubricant mixture enters the through hole in said cam and is deposited on said cam shaft.

4. A four-cycle engine as defined in claim 3 wherein said cam has a base circle surface and the through hole extends from said base circle surface to said cam shaft, said through hole further positioned in alignment with the fuel flow when the combustion chamber is opened to said fuel flow.

* * * * *